US005875617A

United States Patent [19]

Scherer

[11] Patent Number: 5,875,617

[45] Date of Patent: Mar. 2, 1999

[54] OVERHEAD ROTATING TYPE STRETCH FILM WRAPPING MACHINE SUPPORT BEAM STRUCTURE

[75] Inventor: Philip G. Scherer, Fort Lauderdale, Fla.

[73] Assignee: Illinois Tool Works Inc., Glenview, Ill.

[21] Appl. No.: 957,701

[22] Filed: Oct. 24, 1997

[51] Int. Cl.[6] ..... B65B 53/00; B65B 13/04

[52] U.S. Cl. ..... 53/556; 53/588; 52/731.1; 52/731.7

[58] Field of Search ..... 52/648.1, 731.7, 52/732.1, 731.1, 731.2; 53/588, 210, 556

[56] References Cited

U.S. PATENT DOCUMENTS

| | | | |
|---|---|---|---|
| 3,694,990 | 10/1972 | Pamer | 52/731.2 |
| 4,171,597 | 10/1979 | Lester et al. | 52/732.1 |
| 4,938,008 | 7/1990 | Salzsauler | 53/588 X |
| 5,421,141 | 6/1995 | Gordon | 53/588 X |
| 5,499,480 | 3/1996 | Bass | 52/731.1 |
| 5,553,437 | 9/1996 | Navon | 52/731.1 |

OTHER PUBLICATIONS

Cobra Series Model IV, ITW MIMA.
Cobra Series Model III, ITW MIMA.
Cobra XL, ITW MIMA.
Floor Stands, ITW MIMA.

*Primary Examiner*—Linda Johnson
*Attorney, Agent, or Firm*—Schwartz & Weinrieb

[57] ABSTRACT

A support beam structure for use within an overhead rotating type stretch film wrapping machine comprises a main body portion which has a first end which is adapted to be fixedly mounted upon a mounting plate which, in turn, is adapted to be fixedly mounted upon an upstanding fixed support, such as, for example, an I-beam, and a second opposite end which is adapted to support a rotating arm of the overhead rotating type stretch film wrapping machine. The main body portion has a substantially vertically elongated octagonal cross-sectional configuration and comprises a bottom wall, lower lateral divergently angled side members, vertically extending side members, and upper lateral convergently angled side members. The upper lateral side members define tension members for supporting the rotating arm end of the main body portion, and the noted bottom wall and side members of the main body portion are integrally formed together as folded portions of a sheet metal blank.

25 Claims, 5 Drawing Sheets

OVERHEAD ROTATING TYPE STRETCH FILM WRAPPING MACHINE SUPPORT BEAM STRUCTURE

FIELD OF THE INVENTION

The present invention relates generally to stretch film wrapping machines, and more particularly to a stretch film wrapping machine having a new and improved support beam structure incorporated therein which is sufficiently strong, yet relatively light in weight, and is easy and economical to fabricate in view of the fact that extensive internal gusseting, welding, and other labor-intensive processing is effectively eliminated.

BACKGROUND OF THE INVENTION

Stretch film wrapping machines are of course well-known in the packaging industry in connection with the wrapping of various objects, such as, for example, articles, packages, palletized loads, or the like, within stretch wrapping film. An example of one type of stretch film wrapping machine is illustrated in FIG. 1 of the drawings and comprises a COBRA SERIES Model IV Stretch Wrapping Machine which is available from ITW MIMA, 6701 Nob Hill Road, Tamarac, Fla. 33321 which is a corporate subsidiary of ILLINOIS TOOL WORKS INC., 3600 West Lake Avenue, Glenview, Ill. 60025.

In accordance with such a stretch film wrapping machine which is well-known in the industry, the machine is generally indicated by the reference character 10 and is seen to comprise a free-standing floor stand which comprises a vertical standard 12 having a base 14 which is bolted or otherwise fixedly secured to a pair of divergent feet or legs 16 such that the vertical standard 12 is able to be supported upon the floor in a vertically oriented mode. A controller 18, having a keypad 20, is mounted upon the vertical standard 12 so as to be readily accessible to operator personnel in order to control film wrapping or packaging operations.

A substantially horizontally extending support beam structure 22, which is in the form of a structural channel or box beam, has one end thereof fixedly secured, such as, for example, by welding means, to a mounting bracket 24, and the mounting bracket 24 is adjustably secured at a fixed vertical location or elevational level upon the upper end of the vertical standard 12 by means of a plurality of bolt fastener assemblies 17. While support beam structure 22 has been illustrated as being mounted upon the vertical standard 12, it is to be understood and readily appreciated that the support beam structure 22, and the film wrapping mechanisms mounted thereon and to be described hereinafter, may alternatively be directly mounted upon a wall, or a support column, in lieu of being mounted upon the free-standing floor stand comprising vertical standard 12 and leg members 16. In view of the fact that the support beam structure 22 is, in effect, mounted upon the mounting bracket 24 by means of the one end thereof in a cantilevered manner, one or more support struts or tension members 19 are fixedly secured, also by, for example, suitable welding means, at one end thereof to the mounting bracket 24 and at the other opposite end thereof to the free distal end of the support beam structure 22 whereby the free distal end of the support beam structure 22 is adequately supported in tension so as to, in turn, be able to adequately carry or support the weight of the stretch film wrapping components which will now be described.

The free distal end of the support beam structure 22 has a horizontally extending support arm 26 rotatably mounted thereon and which is adapted to be rotatably driven by a suitable drive motor and operatively associated gearing, not shown in the drawing, wherein such drive components are housed within the support beam structure 22. In turn, the free distal end of the horizontally extending support arm 26, that is, the end disposed opposite the end which is rotatably mounted upon the support beam structure 22, is provided with a vertically extending downright 28 upon which a stretch head or carriage 30 is reciprocably mounted for vertically upward and downward movements attendant the wrapping or packaging of an article, package, or palletized load 32 which is disposed in a stationary mode at a wrapping station 34.

The stretch head or carriage 30 is provided with a supply roll of wrapping film 36, from which wrapping film 38 is withdrawn or uncoiled so as to wrap or package, for example, the palletized load 32, and a plurality of tension rollers 40 which develop a predetermined amount of tension within the wrapping film 38 in accordance with, or relative to, the particular loads to be wrapped or packaged. It is noted that the stretch head or carriage 30 is provided with a centrally located, vertically oriented housing 42 which accommodates the downright 28 such that the stretch head or carriage 30 can vertically reciprocate therealong in the upward and downward directions, however, the remaining structure of the stretch head or carriage 30, including the supply roll of wrapping film 36 and the tension rollers 40, are oriented in a tilted mode at a predetermined angle with respect to the vertical such that lowermost regions of, for example, palletized load 32, that is, those regions adjacent to the floor of the wrapping station 34, may nevertheless be wrapped or packaged within the wrapping film 38.

As is well-known in the industry, stretch film wrapping machines of the type exemplified by wrapping machine 10 serve to wrap or package articles, packages, or palletized loads 32 located at the wrapping station 34 as a result of continuously wrapping the load 32 in wrapping film 38 wherein the wrapping operation is achieved through means of a combination of simultaneous movements comprising the rotary movement of the horizontally extending support arm 26 about its rotary axis defined adjacent to the free distal end of the support beam structure 22, and the vertically reciprocable upward and downward movements of the stretch head or carriage 30 upon which the supply roll of wrapping film 36 is mounted.

While the aforenoted exemplary stretch film wrapping machine 10 is highly respected for its performance characteristics which has led to its substantial commercial success, the support beam structure 22 of the machine is a relatively heavy structural component which imparts considerable weight to the overall machine. In addition, the support beam structure 22 comprises a plurality of separate components which must be welded together and requires internal support plates and extensive gusseting whereby the fabrication process for manufacturing the support beam structure 22 is labor intensive and therefore relatively expensive.

A need therefore exists in the art for a new and improved support beam structure which is able to be incorporated within stretch film wrapping machines wherein such support beam structure is sufficiently strong, yet relatively light in weight, and wherein further, the support beam structure is relatively easy and economical to manufacture in view of the fact that extensive internal gusseting, welding, and other labor-intensive processing procedures are effectively able to be eliminated.

OBJECTS OF THE INVENTION

Accordingly, it is an object of the present invention to provide a new and improved support beam structure which is specifically structure so as to be able to be incorporated within existing stretch film wrapping machines.

Another object of the present invention is to provide a new and improved support beam structure which is able to be incorporated within existing stretch film wrapping machines and wherein the various disadvantages and drawbacks characteristic of conventional stretch film wrapping machine support beam structures are effectively overcome.

A further object of the present invention is to provide a new and improved support beam structure which is able to be incorporated within existing stretch film wrapping machines, and wherein the new and improved support beam structure exhibits sufficient strength, is relatively light in weight, and is easy and economical to manufacture in view of the fact that extensive internal gusseting, welding, and other labor-intensive processing procedures are able to be effectively eliminated.

SUMMARY OF THE INVENTION

The foregoing and other objectives are achieved in accordance with the principles and teachings of the present invention through the provision of a new and improved support beam structure which is able to be incorporated within existing stretch film wrapping machines and which comprises a support beam structure which is fabricated from sheet metal stock material. The sheet metal stock material has a predetermined unfolded form or plan layout and is folded, by means of, for example, conventional sheet metal forming brake apparatus, into a structural channel or box beam structure which is open at the upper or top end thereof. One end of the formed structural channel or box beam structure is adapted to be welded to a support plate which, in turn, is adapted to be mounted upon a wall structure, a support column or I-beam, or a floor stand, and the opposite end of the formed structural channel or box beam structure is adapted to rotatably support a rotatable arm component of the wrapping machine upon which the supply roll of wrapping film is mounted.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
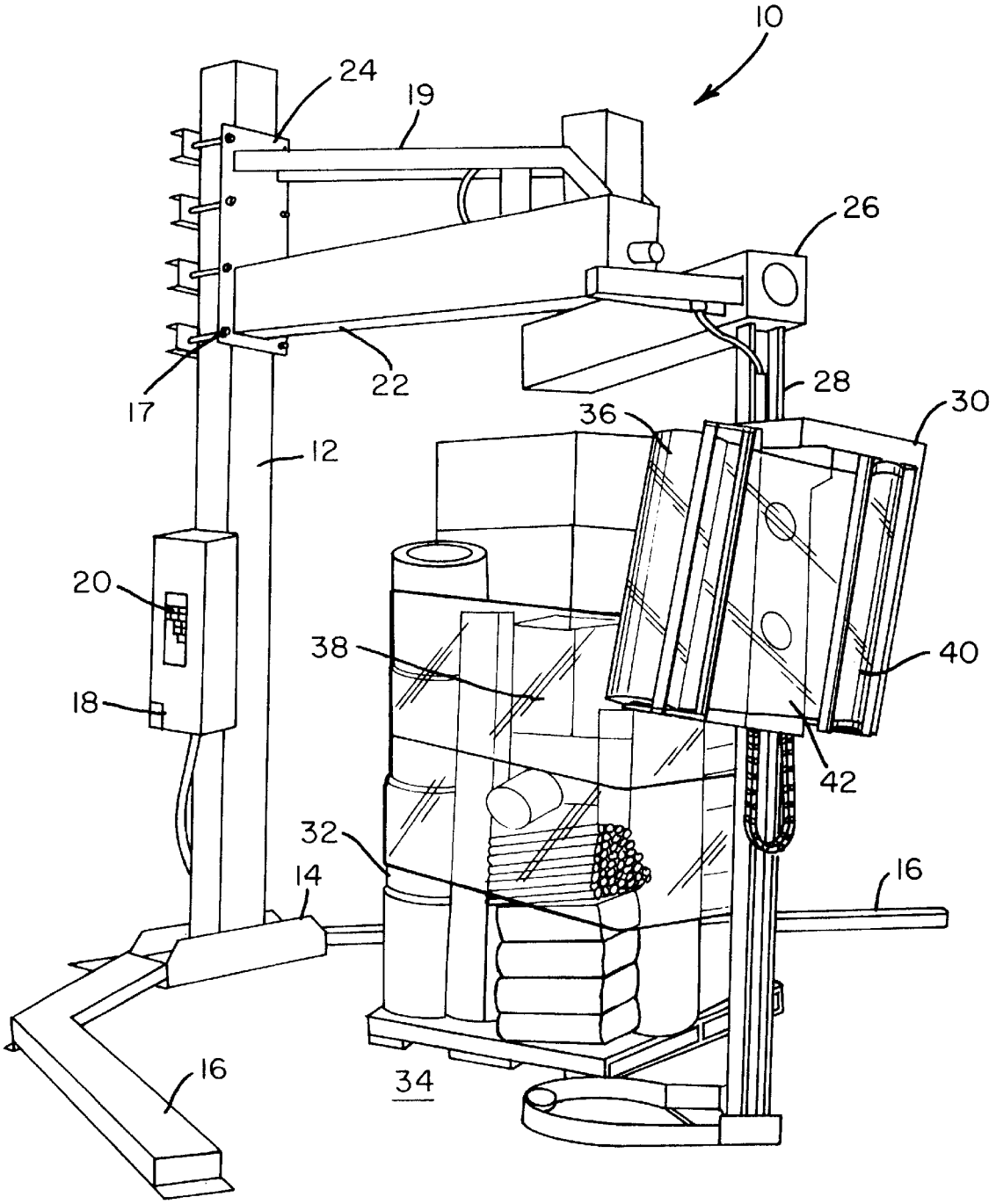
FIG. 1 PRIOR ART
FIG. 1 is a perspective view of a conventional overhead rotating type stretch film wrapping machine showing the various operative components thereof including a conventional support beam structure comprising a structural channel or box beam fabricated from a plurality of components which are welded together.
Figure 2:
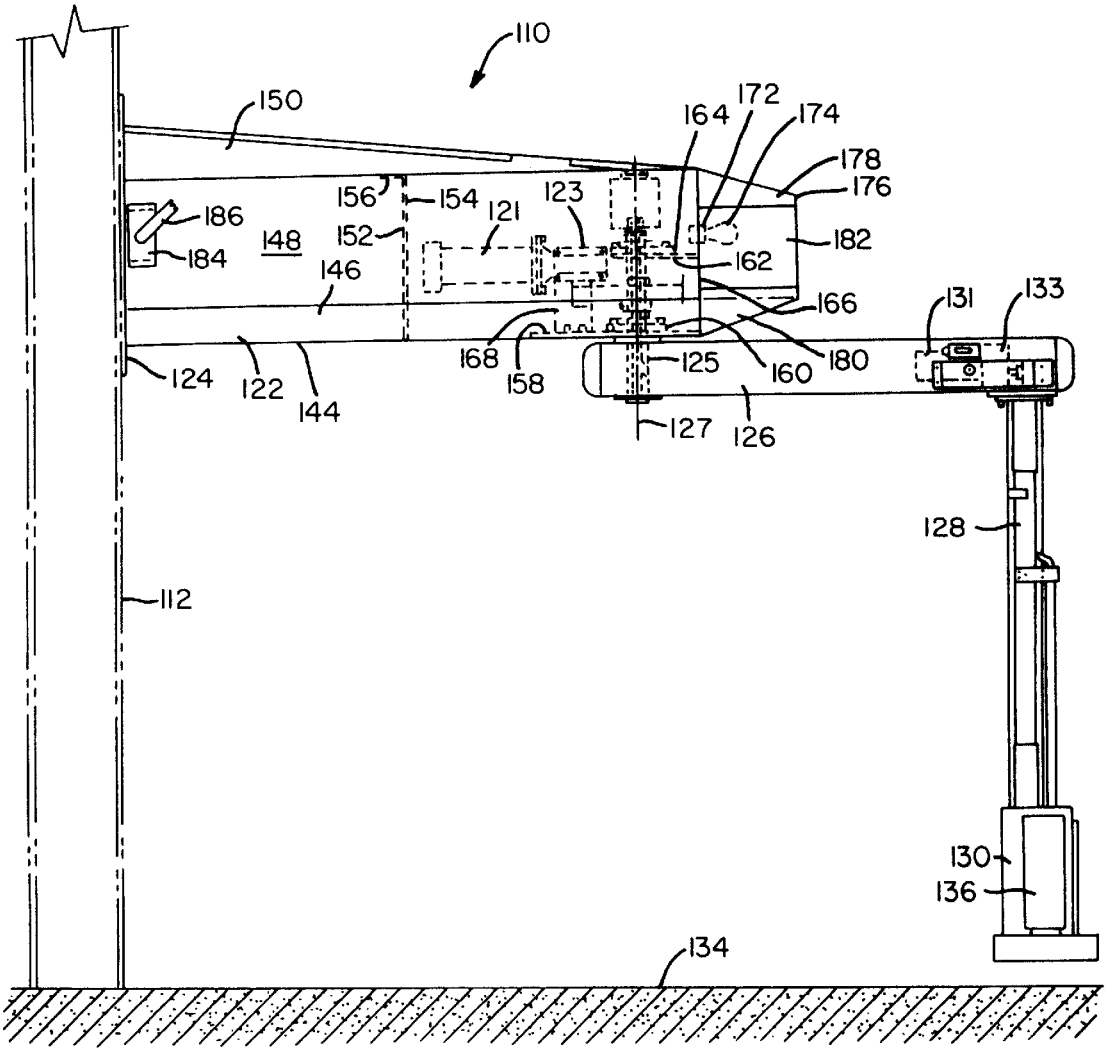
FIG. 2 is a left side elevational view of an overhead rotating type stretch film wrapping machine showing the various operative components thereof and having the new and improved support beam structure, constructed in accordance with the principles and teachings of the present invention, incorporated therein.
Figure 3:
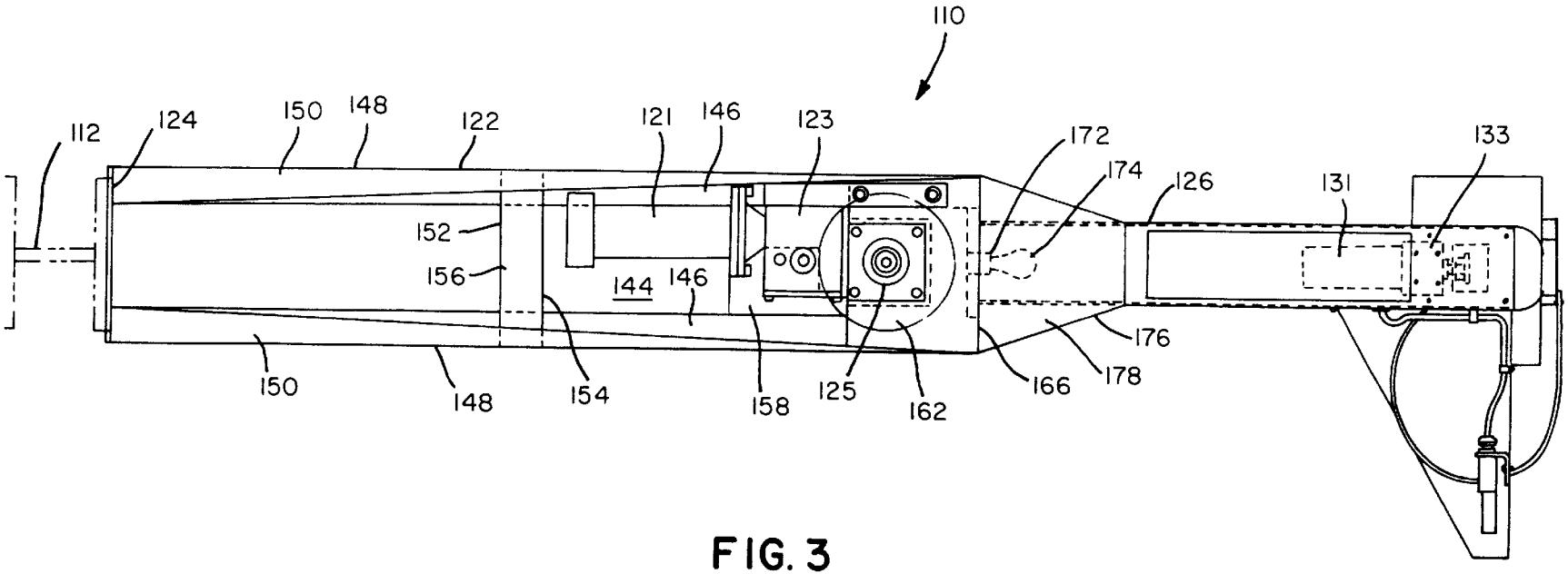
FIG. 3 is a top plan view of the overhead rotating type stretch film wrapping machine of FIG. 2.

Referring now to the drawings, and more particularly to FIGS. 2 and 3 thereof, an exemplary overhead rotating type stretch film wrapping machine, having the new and improved support beam structure constructed in accordance with the principles and teachings of the present invention and incorporated therein, is illustrated and generally indicated by the reference character 110. It is to be noted that the various structural components of the overhead rotating type stretch film wrapping machine 110, which correspond to the conventional overhead rotating type stretch film wrapping machine 10 illustrated in FIG. 1, will be designated by similar reference characters where applicable except that the reference characters will be within the 100 series.

As was the case with the conventional overhead rotating type stretch film wrapping machine 10, the overhead rotating type stretch film wrapping machine 110 constructed in accordance with the principles and teachings of the present invention is seen to comprise a support beam structure 122 having one end thereof fixedly mounted, by suitable means, such as, for example, bolt fasteners, not shown, to an upstanding I-beam 112, although it is to be readily understood that in lieu of upstanding I-beam 112, the support beam structure 122 can also be fixedly secured to a vertical wall or a free-standing floor stand comprising a vertical standard. The support beam structure 122 is secured to an upper region of the upstanding I-beam 112 at a predetermined elevational level by means of a mounting bracket 124 through which the bolt fasteners, not shown, pass so as to secure the mounting bracket 124 to the upstanding I-beam 112, and the lower end of the upstanding I-beam 112 is of course affixed to a predetermined floor region which defines a wrapping station 134.

The end of the support beam structure 122, which is disposed opposite the end fixedly secured to the upstanding I-beam 112 by means of the mounting bracket 124 and the bolt fasteners, has a first end of a horizontally disposed support arm 126 rotatably mounted thereon, and suitable drive means, comprising, for example, a drive motor 121, drive gearing 123, and a vertically disposed drive shaft 125, are housed within the support beam structure 122, with the lower end portion of the drive shaft 125 operatively connected to the horizontally disposed support arm 126, so as to rotatably drive the horizontally disposed support arm 126 about a vertical axis 127. The second end of the horizontally disposed support arm 126, which is disposed opposite the end rotatably connected to support beam structure 122, has a vertically extending downright 128 fixedly mounted thereon, and a stretch head 130, having a supply roll of wrapping film 136 mounted thereon, is mounted upon the downright 128 so as to be reciprocably driven in vertically upward and downward directions by suitable drive means comprising, for example, a drive motor 131 and drive gearing 133, housed within the second end of the horizontally disposed support arm 126.

Having described the overall or general structure of the overhead rotating type stretch film wrapping machine 110 constructed in accordance with the principles and teachings of the present invention and showing the cooperative parts thereof, and in view of the fact that the basic operation of the overhead rotating type stretch film wrapping machine 110 of the present invention in connection with the wrapping of articles, packages, or palletized loads disposed at the wrapping station 134 is essentially the same as the basic wrapping or packaging operation of the overhead rotating type stretch film wrapping machine 10 of FIG. 1, a discussion of such a wrapping process attendant the operation of the overhead rotating type stretch film wrapping machine 110 of the present invention will be omitted and attention will now be focused upon the construction and those structural features and components of the support beam structure 122 of the overhead rotating type stretch film wrapping machine 110 which actually comprise the present invention.

More particularly, in lieu of the conventional support beam structure 22 as disclosed within the overhead rotating type stretch film wrapping machine 10 of FIG. 1, wherein the conventional support beam structure 22 is fabricated from a plurality of or multiple support beam components which are subsequently welded together so as to form the resulting box beam or structural channel, the main body portion of the support beam structure 122 of the present invention is fabricated, in effect, from a single sheet metal blank which is folded in accordance with a predetermined plan or format whereby the resulting support beam structure 122 is achieved.

Figure 4:
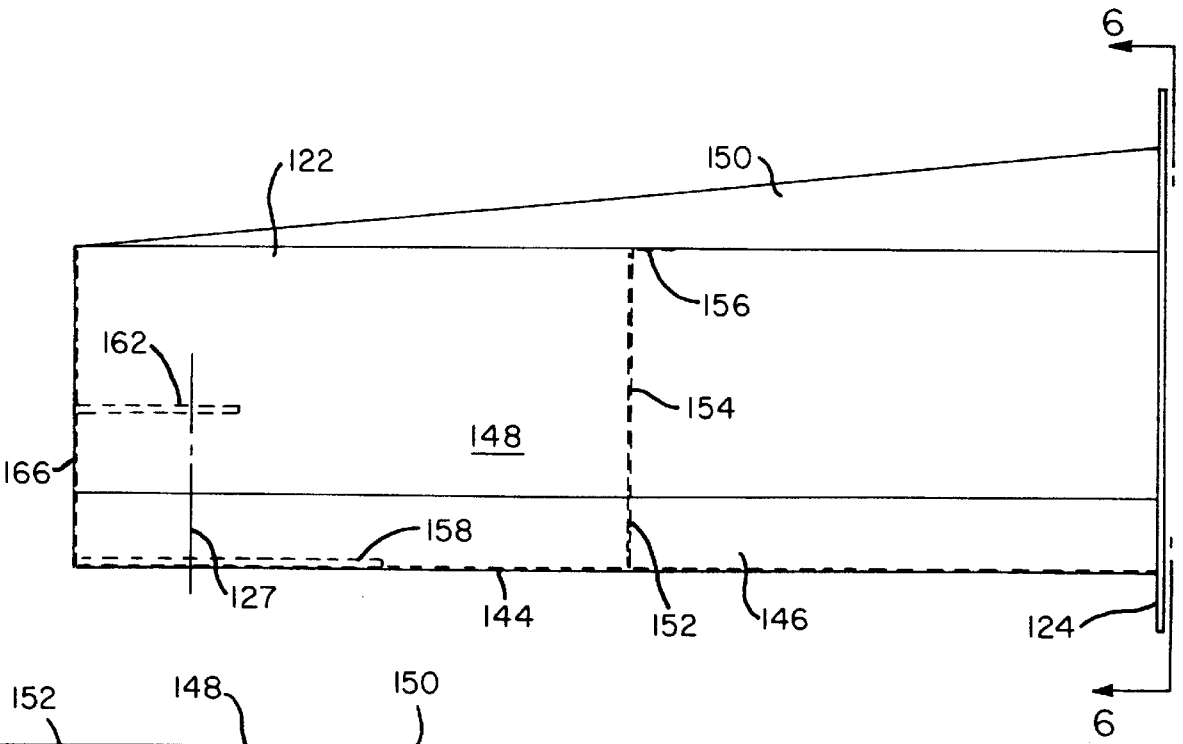
FIG. 4 is a right side elevational view of the new and improved support beam structure constructed in accordance with the principles and teachings of the present invention.
Figure 5:
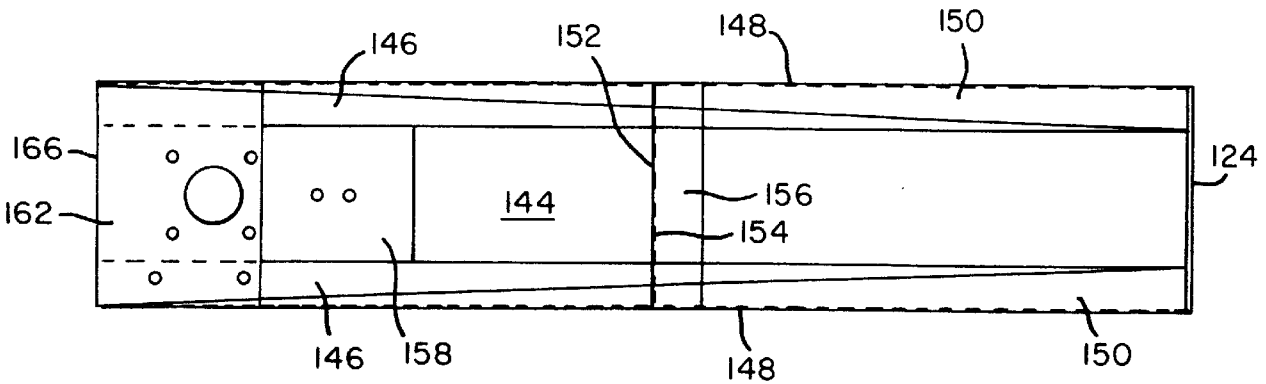
FIG. 5 is a top plan view of the new and improved support beam structure shown in FIG. 4.
Figure 6:
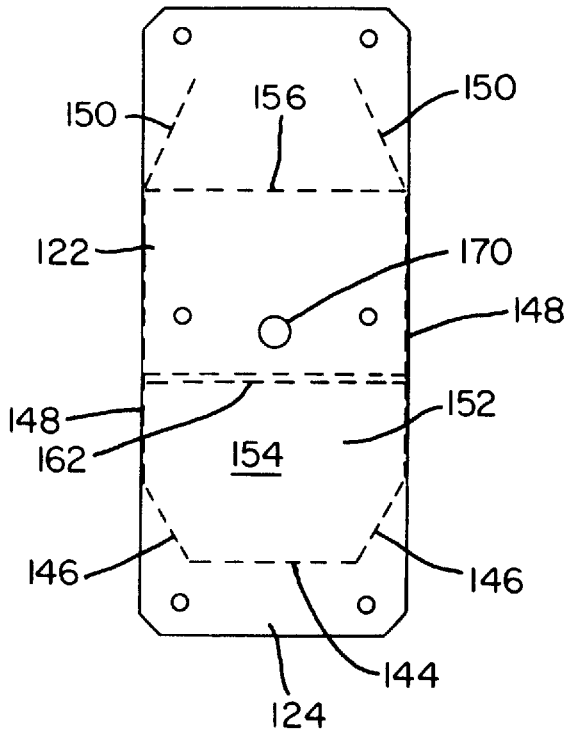
FIG. 6 is an end elevational view of the new and improved support beam structure shown in FIG. 4 and taken along the lines 6—6 of FIG. 4.

With additional reference being made to FIGS. 4–6, and as has been noted hereinbefore, the support beam structure 122 of the present invention is fabricated from a single sheet metal blank which is folded in such a manner that the cross-sectional configuration of the support beam structure 122 is substantially that of a vertically elongated octagon with the uppermost horizontal side omitted. This is initially best seen and appreciated from FIG. 6 which is an end elevational view which is an end elevational view of the support beam structure 122 as taken along the line 6—6 of FIG. 4. More particularly, it is seen that the support beam structure 122 comprises a lowermost, horizontally disposed bottom side 144, and a pair of lower lateral sides 146,146 respectively integrally connected to opposite sides of the bottom side 144 and disposed at predetermined divergent angles with respect to bottom side 144 and with respect to each other. A pair of vertically oriented sides 148,148 are respectively integrally connected to the upper ends of lower angled sides 146,146, and a pair of upper lateral sides 150,150 are respectively integrally connected to the upper ends of the vertically oriented sides 148,148 and are disposed at predetermined convergent angles with respect vertically oriented sides 148,148 and with respect to each other.

The end of of the support beam structure 122 which is adapted to be connected to the mounting bracket or support plate 124 is integrally connected to the mounting bracket or support plate 124 by means of a suitable welding operation, and the assembly comprising the mounting bracket or support plate 124 and the support beam structure 122 is then able to be fixedly mounted upon the upstanding I-beam 112 by suitable fastening means, such as, for example, bolt fasteners, not shown. In order to provide structural support and integrity for the support beam structure 122 along its longitudinal extent, a single gusset plate 152, disposed transversely with respect to the longitudinal extent or axis of the support beam structure 122, is disposed or located at an axial position which is approximately midway between the longitudinally separated opposite ends of the support beam structure 122, as best seen in FIG. 2.

The single gusset plate 152 has a substantially inverted and reversely oriented L-shaped configuration, as best seen in FIG. 2, and is therefore seen to comprise a long leg portion 154 and a short leg portion 156. As can best be seen or appreciated from FIG. 6, the long leg portion 154 of the gusset plate 152 has a configuration which essentially matches or corresponds to the dimensions and relative angular orientations of the various sides 144, 146, and 148 of the support beam structure 122, and it to be further noted that the upper lateral sides 150,150 of the support beam structure 122 are bent around laterally outer edges of the short leg portion 156 of the gusset plate 152. The outer peripheral edge regions of the long leg portion 154 of the gusset plate 152 are adapted to be respectively welded to the bottom side 144, the lower lateral sides 146,146, and the vertically oriented sides 148,148 of the support beam structure 122 so as to fixedly secure the gusset plate 152 within the support beam structure 122 whereby the gusset plate 152 provides enhanced or increased structural rigidity or integrity to the support beam structure 122.

As can best be appreciated from FIGS. 2, 4, and 5, it is seen that the upper lateral sides 150,150 of the support beam structure 122 are tapered in the longitudinal direction extending from the free distal end of the support beam structure 122, upon which the rotating, horizontally disposed support arm 126 is disposed, to the proximal end of the support beam structure 122 which is fixedly secured to the mounting bracket 124 such that the larger dimensional ends of the upper lateral sides 150,150 are disposed adjacent, and are able to be welded, to the mounting bracket 124. In short, the upper lateral sides 150,150 of the support beam structure 122 each have a substantially right-triangular configuration wherein the longer leg sides are integral with the vertically extending lateral sides 148,148 of the supprt beam structure 122 while the short leg sides are welded to the mounting bracket 124.

With the foregoing structure, it is to be appreciated that the upper lateral sides 150,150 of the support beam structure 122 serve as structural tension members, similar to the support struts or tension members 19 operatively connected to the support beam structure 22 of the conventional overhead rotating type stretch film wrapping machine 10 illustrated within FIG. 1.

The unique difference between the support beam structure 122 constructed in accordance with the teachings and principles of the present invention and illustrated in FIG. 2, for example, as compared with the conventional support beam structure 22 utilized within the conventional overhead rotating type stretch film wrapping machine 10 illustrated in FIG. 1, is that not only is the main body portion of the support beam structure 122 fabricated from a single metal blank in accordance with the aforenoted metal working or bending operations performed upon a mechanical or metal working brake, but in addition, in lieu of the provision of the separate support struts or tension members 19 characteristic of the support beam structure 22 of the conventional overhead rotating type stretch film wrapping machine 10, the support struts or tension members 150 of the support beam structure 122 of the present invention overhead rotating type stretch film wrapping machine 110 are integral components of the one-piece construction or structure comprising the main body portion of the support beam structure 122 of the overhead rotating type stretch film wrapping machine 110 of the present invention.

In order to complete the assembly of the support beam structure 122, a lower bearing plate 158 is mounted within the support beam structure 122 and is adapted to be welded to the bottom side 144 of the support beam structure 122. The lower bearing plate 158 is provided with a bearing collar 160 for rotatably supporting a lower portion of the drive shaft 125. An upper bearing plate 162 is mounted at an approximately midway elevational level within the support beam structure 122 and is similarly provided with a bearing collar 164 for rotatably mounting an upper portion of the drive shaft 125. The upper bearing plate 162 is adapted to be welded to the vertically extending sides 148,148 of the support beam structure 122 as well as to an end plate 166, wherein the latter is in turn additionally welded to the vertically extending sides 148,148, the lower lateral sides 146,146, the lower bearing plate 158, and the bottom side 144 of the support beam structure 122.

The lower bearing plate 158 also has an upstanding support plate 168 bolted thereto for supporting the drive motor and gearing components 121,123, and the end plate 166 is provided with an aperture 170 within which a light bulb socket 172 is mounted for holding a light bulb 174 which is illuminated during operation of the overhead rotating type stretch film wrapping machine 110 so as to indicate to operating personnel that the overhead rotating type stretch film wrapping machine 110 is in fact in operation. The light bulb 174 is enclosed within a housing 176 which comprises upper and lower sheet metal housing covers 178 and 180, and a centrally located housing cover 182 fabricated from a suitable transparent or translucent plastic material so as to permit the light from the light bulb 174 to be transmitted therethrough. In order to provide electrical power to the various electrical components of the overhead rotating type stretch film wrapping machine 110, the left vertically extending side wall 148 is provided with a mounting plate 184 through which an electrical cable 186 is conducted, the pathway of the cable 186 internally of the main body portion of the support beam structure 122 having been omitted from the drawings for clarity purposes.

Thus it may be seen that in accordance with the principles and teachings of the present invention, the main body portion of the support beam structure 122 of the overhead rotating type stretch film wrapping machine 110 is constructed as a one-piece integral unit or component, and in particular, is formed from a sheet metal blank such that the primary or main body portion of the support beam structure 122 comprises the bottom side or wall 144, the lower lateral sides or walls 146,146, the vertically extending sides or walls 148,148, and the upper lateral sides or walls 150,150 which serve as tension members or struts. Accordingly, the overall weight of the support beam structure 122 is remarkably reduced, as is the number of structural components comprising the support beam structure 122 as compared to the conventional support beam structure 22, and the support beam structure 122 can be more economically manufactured in view of the fact that the production process is less labor-intensive as compared to that involved in connection with the fabrication of the conventional support beam structure 22.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A support beam structure, comprising:

a main body portion having a first end thereof adapted to be fixedly mounted upon a fixed support, a second end thereof adapted to support a dependent load and longitudinally spaced from said first end of said main body portion, and at least a longitudinally extending bottom wall member, a pair of opposite lateral side members having lower longitudinally extending portions thereof connected to said bottom wall member, and a pair of tension members having lower longitudinally extending portions thereof connected to upper longitudinally extending portions of said opposite lateral side members so as to support said second end of said main body portion with respect to said first end of said main body portion, wherein said bottom wall member, said pair of opposite lateral side members, and said pair of tension members extend longitudinally between said first and second ends of said main body portion; and wherein further, said main body portion comprising said at least bottom wall member, said pair of opposite lateral side members, and said pair of tension members, comprises a one-piece sheet metal structure foldably formed from a sheet metal blank so as to define said at least bottom wall member, said pair of opposite lateral side members, and said pair of tension members.

2. The support beam structure as set forth in claim 1, wherein:

said main body portion has a geometrical cross-sectional configuration.

3. The support beam structure as set forth in claim 2, wherein:

said geometrical cross-sectional configuration of said main body portion comprises a substantially elongated octagon.

4. The support beam structure as set forth in claim 3, wherein:

said octagonally configured main body portion comprises a bottom wall, lower lateral sides integrally connected to opposite sides of said bottom wall, vertically oriented sides integrally connected respectively to said lower lateral sides, and upper lateral sides integrally connected to said vertically oriented sides.

5. The support beam structure as set forth in claim 1, further comprising:

a gusset plate fixedly disposed within said main body portion at a longitudinal position which is substantially midway between said first and second ends of said main body portion.

6. The support beam structure as set forth in claim 5, wherein:

said gusset plate has a substantially inverted and reversely oriented L-shaped cross-sectional configuration.

7. The support beam structure as set forth in claim 4, further comprising:

a mounting plate fixedly secured to said first end of said main body portion for mounting said support beam structure upon a fixed support.

8. The support beam structure as set forth in claim 7, wherein:

said upper lateral sides of said main body portion extend from said second end of said main body portion to said first end of said main body portion and define said tension members wherein end portions of said upper lateral side tension members located at said first end of said main body portion are fixedly secured to said mounting plate.

9. A support beam structure for use within an overhead rotating type stretch film wrapping machine, comprising:

a main body portion having a first end thereof adapted to be fixedly mounted upon a fixed support, a second end thereof adapted to support a dependent load and longitudinally spaced from said first end of said main body portion, and at least a longitudinally extending bottom wall member, a pair of opposite lateral side members having lower longitudinally extending portions thereof connected to said bottom wall member, and a pair of tension members having lower longitudinally extending portions thereof connected to upper longitudinally extending portions of said opposite lateral side members so as to support said second end of said main body portion with respect to said first end of said main body portion, wherein said bottom wall member, said pair of opposite lateral side members, and said pair of tension members extend longitudinally between said first and second ends of said main body portion; and wherein further, said main body portion comprising said at least bottom wall member, said pair of opposite lateral side members, and said pair of tension members, comprises a one-piece sheet metal structure foldably formed from a sheet metal blank so as to define said at least bottom wall member, said pair of opposite lateral side members, and said pair of tension members.

10. The support beam structure as set forth in claim 9, wherein:

said main body portion has a geometrical cross-sectional configuration.

11. The support beam structure as set forth in claim 10, wherein:

said geometrical cross-sectional configuration of said main body portion comprises a substantially elongated octagon.

12. The support beam structure as set forth in claim 11, wherein:

said octagonally configured main body portion comprises a bottom wall, lower lateral sides integrally connected to opposite sides of said bottom wall, vertically oriented sides integrally connected respectively to said lower lateral sides, and upper lateral sides integrally connected to said vertically oriented sides.

13. The support beam structure as set forth in claim 9, further comprising:

a gusset plate fixedly disposed within said main body portion at a longitudinal position which is substantially midway between said first and second ends of said main body portion.

14. The support beam structure as set forth in claim 13, wherein:

said gusset plate has a substantially inverted and reversely oriented L-shaped cross-sectional configuration.

15. The support beam structure as set forth in claim 12, further comprising:

a mounting plate fixedly secured to said first end of said main body portion for mounting said support beam structure upon a fixed support.

16. The support beam structure as set forth in claim 15, wherein:

said upper lateral sides of said main body portion extend from said second end of said main body portion to said first end of said main body portion and define said tension members wherein end portions of said upper lateral side tension members located at said first end of said main body portion are fixedly secured to said mounting plate.

17. In combination, an overhead rotating type stretch film wrapping machine comprising a fixed support, a support beam structure having a first end thereof fixedly secured to said fixed support, a rotating arm having a first end thereof rotatably mounted upon a second end of said support beam structure, a downright mounted upon a second end of said rotating arm, and a wrapping film stretch head reciprocably mounted for vertical movements upon said downright, the improvement comprising:

said support beam structure comprising a main body portion having a first end thereof adapted to be fixedly mounted upon said fixed support, a second end thereof adapted to support said rotary arm and longitudinally spaced from said first end of said main body portion, and at least a longitudinally extending bottom wall member, a pair of opposite lateral side members having lower longitudinally extending portions thereof connected to said bottom wall member, and a pair of tension members having lower longitudinally extending portions thereof connected to upper longitudinally extending portions of said opposite lateral side members so as to support said second end of said main body portion with respect to said first end of said main body portion, wherein said bottom wall member, said pair of opposite lateral side members, and said pair of tension members extend longitudinally between said first and second ends of said main body portion; and wherein further, said main body portion comprising said at least bottom wall member, said pair of opposite lateral side members, and said pair of tension members, comprises a one-piece sheet metal structure foldably formed from a sheet metal blank so as to define said at least bottom wall member, said pair of opposite lateral side members, and said pair of tension members.

18. The combination as set forth in claim 17, wherein:

said main body portion has a geometrical cross-sectional configuration.

19. The combination as set forth in claim 18, wherein:

said geometrical cross-sectional configuration of said main body portion comprises a substantially elongated octagon.

20. The combination as set forth in claim 19, wherein:

said octagonally configured main body portion comprises a bottom wall, lower lateral sides integrally connected to opposite sides of said bottom wall, vertically oriented sides integrally connected respectively to said lower lateral sides, and upper lateral sides integrally connected to said vertically oriented sides.

21. The combination as set forth in claim 17, further comprising:

a gusset plate fixedly disposed within said main body portion at a longitudinal position which is substantially midway between said first and second ends of said main body portion.

22. The combination as set forth in claim 21, wherein:

said gusset plate has a substantially inverted and reversely oriented L-shaped cross-sectional configuration.

23. The combination as set forth in claim 20, further comprising:

a mounting plate fixedly secured to said first end of said main body portion for mounting said support beam structure upon a fixed support.

24. The combination as set forth in claim 23, wherein:

said upper lateral sides of said main body portion extend from said second end of said main body portion to said first end of said main body portion and define said tension members wherein end portions of said upper lateral side tension members located at said first end of said main body portion are fixedly secured to said mounting plate.

25. The combination as set forth in claim 17, further comprising:

a plurality of bearing plates fixedly mounted within said main body portion of said support beam structure for supporting a drive motor and drive gearing for driving said rotating arm.

* * * * *